United States Patent [19]

de Vries

[11] 4,352,250

[45] Oct. 5, 1982

[54] SUCTION DREDGER INSTALLATION

[75] Inventor: Huibert de Vries, Alblasserdam, Netherlands

[73] Assignee: Koninklijke Bos Kalis Westminster Group N.V., Papendrecht, Netherlands

[21] Appl. No.: 212,744

[22] Filed: Dec. 3, 1980

[30] Foreign Application Priority Data

Dec. 12, 1979 [NL] Netherlands ..... 7908959

[51] Int. Cl.[3] ..... E02F 3/90

[52] U.S. Cl. ..... 37/58; 37/72

[58] Field of Search ..... 37/72, 58; 285/223

[56] References Cited

U.S. PATENT DOCUMENTS

| | | | |
|---|---|---|---|
| 3,302,315 | 2/1967 | Himes | 37/72 |
| 3,490,157 | 1/1970 | Venus | 37/58 X |
| 3,681,862 | 8/1972 | DeKoning et al. | 37/58 |
| 3,828,451 | 8/1974 | DeKoning et al. | 37/72 X |

FOREIGN PATENT DOCUMENTS

| | | | |
|---|---|---|---|
| 6410256 | 3/1966 | Netherlands | 37/72 |
| 7108106 | 12/1972 | Netherlands | 37/72 |

*Primary Examiner*—Clifford D. Crowder

*Attorney, Agent, or Firm*—Cushman, Darby & Cushman

[57] ABSTRACT

A suction dredger installation provided with a vessel, at least one pump, at least one suction pipe hingedly connected to the vessel, said suction pipe comprising three pipe sections hingedly interconnected, the first of which is supported by a ladder, and together therewith being adapted for hinged movement relative to the vessel about a horizontal shaft extending thwartships and being connected to the second suction pipe section in lazy tong relationship, and means for controlling the position of the suction pipe, of which the control means for the position of the second suction pipe section are mounted on the ladder adjacent the pivot pin thereof with the vessel.

3 Claims, 2 Drawing Figures

A

SUCTION DREDGER INSTALLATION

Figures 1, 2:
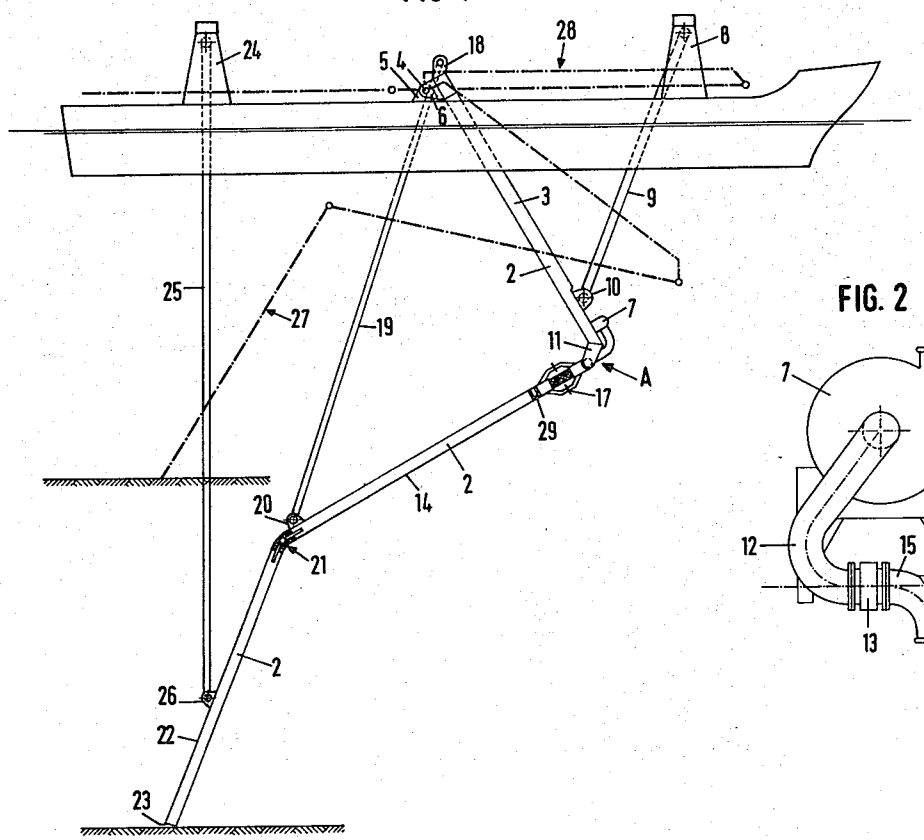

The invention relates to a suction dredger installation provided with a vessel, at least one pump, at least one suction pipe pivotally connected to the vessel, said suction pipe comprising three pivotally interconnected pipe sections, the first suction pipe section being supported by a ladder and together therewith being connected to the vessel in downwardly hinged relationship via a horizontal shaft extending thwartships from a substantial horizontal position, and means for controlling the position of the suction pipe relative to the vessel.

Such a suction dredger installation is disclosed in Dutch patent application 64,10256. The first two suction pipe sections therein are supported by a substantially U-shaped carrier which is formed by two ladders each carrying a first suction pipe section, said ladders being connected to the vessel adjacent their end, hinging about a horizontal shaft, and adjacent the other end being coupled mutually rigidly by a connecting leg. The hinged connection between the carrier and the vessel is such that the carrier is adapted for pivotal movement into a vertical position from a horizontal position wherein the connecting leg extends in tranverse direction before the bow. Adjacent the transition between each ladder and the connecting leg of the carrier, there is positioned thereon a pump which is consequently disposed each time adjacent the suction end of one of the first suction pipe sections. The carrier is furthermore provided along the entire length of each ladder with means for conducting the delivery nozzle of a second suction pipe section from the deck of the vessel into a coupling position with the pump. The suction pipes are brought in the operative position by pivoting downwards the carrier with pumps and first suction pipe sections into a substantially vertical position by means of first control means positioned adjacent the bow of the vessel and subsequently by urging the carrier to guidingly lower two second suction pipe sections with each time hingedly coupled thereto a third suction pipe section by hoisting installations until the coupling with the first suction pipe sections is effected, after which the position of respectively the second suction pipe sections and the third suction pipe sections relative to the first, respectively the second is controlled by the hoisting installations which are positioned on the deck of the vessel.

By means of said suction dredger installation, large suction depths can be attained. However, in case suction operations have to be carried out with this prior art installation, whereby the suction nozzle has to be displaced substantially vertically along some distance, this will require frequently laborious and accurate manoeuvring with the vessel.

It is the object of the invention to eliminate this problem and to provide a vessel which stationary positioned is adapted to displace the suction nozzle, accurately steered, in substantially vertical direction, whereby moreover the position of the suction nozzle end of the third suction pipe section can be optimized over a wide range of suction depths.

This is achieved, according to the invention with a suction dredger installation of the above described type when the hinged coupling between the first and the second suction pipe section is designed in such a way that said suction pipe sections can enclose a mutual angle between 0 and 180° in lazy tong relationship, and that the means for controlling the position of the second suction pipe section relative to the first suction pipe section are disposed on the ladder adjacent the hinge pin thereof with the vessel. These features allow the first and the second suction pipe section to perform a lazy tong movement relative to each other, in such a way that the suction nozzle end of the suction pipe relative to the vessel is only displaced in vertical direction. It will then be possible, upon application of conventional suction pipe sections for instance to displace the suction nozzle along a distance of 30 m substantially exclusively in vertical direction in case of stationary vessel. It is also possible through these features for in particular the last suction pipe section to always occupy the optimal position relative to the bottom over a large variety of suction depths. The control of both the suction depth and the position of the suction nozzle end of the third suction pipe section can be realized relatively simply by positioning on the ladder means for controlling the position of the second suction pipe section relative to the first suction pipe section. Through this feature there is created a triangular configuration between the first suction pipe section, the second suction pipe section and the hoisting rope, which considerably simplifies the location of the end of the second suction pipe section, which is hingedly connected to the third suction pipe section. Besides these features likewise enable to obtain a favourable hoisting rope position from the viewpoint of forces.

An additional, particularly advantageous effect of the features proposed according to the invention is that the suction pipe in its above-water position occupies considerably less length than in case with the prior art construction. The reason is that now the first and the second suction pipe section in that position are in collapsed condition, so that the total length occupied by the suction tube has been reduced by an amount substantially equal to the length of the first of the two suction pipe sections relative to that of the prior art suction tubes. This again implies that the length of the vessel may be shorter by the same amount. The advantage of this feature need not be further elucidated.

The width of the suction pipe and hence the total width of the vessel can be kept minimal if in a suction dredger installation wherein adjacent the hinged coupling there is provided a pump between the first and second suction pipe section by means of a rotary gland with horizontal shaft oriented thwartships on a ladder supporting the first suction pipe section, in accordance with a preferred embodiment of the invention the pump is connected to the rotary gland through a substantially Z-shaped bend with legs, the axes of which lie substantially in mutual parallel planes and intersecting each other perpendicularly. As a result likewise an advantageous arrangement of the pump and the drive thereof is obtained.

It is observed that Dutch patent application 71,08106 discloses a dredging installation provided with a ladder consisting of two portions interconnected in lazy tong relationship, which may enclose a mutual angle between 0 and 180°. A third suction pipe section however is not employed therein, nor the positioning of the control means for the position of the second suction pipe section on the ladder adjacent the pivot pin thereof with the vessel.

One embodiment of the suction dredger installation according to the invention will now be described, by way of example, with reference to the accompanying drawing wherein FIG. 1 shows a suction dredger installation according to the invention in side view;

FIG. 2 is a view according to the arrow A in FIG. 1 on an enlarged scale.

The diagrammatically shown suction dredger installation according to the invention is provided with a vessel 1 provided with a three-section suction pipe 2.

The first suction pipe portion, which is supported by a ladder 3, is not shown in the drawing for the sake of clarity, in which respect it is observed that the movement of the first suction pipe section can be deemed identical to that of the ladder 3. The latter is hingedly connected to the vessel 1 through a first pivot pin 4, the axis of which extends horizontally in thwartships direction. It should be noted that the frame 5, which is connected to the vessel, is designed in such a way that it or the coacting rotary flange 6 connected to the ladder enables the ladder 3 to swivel along the side of the vessel 1. The ladder 3 furthermore carries a pump 7 as well as drive means, not shown, for said pump 7. The ladder 3 is controllably swivable by means of lifting device 8 which coacts through a rope 9 with a hoist 10 connected to the ladder 3. At the bottom end of the ladder 3 there is provided a support portion 11 enclosing an angle with the longitudinal direction of the ladder, said support portion 11 supporting a connection tube 12 connected with its one end to the pump 7 and forming part of the first suction pipe portion. The other end of the connection tube 12 is connected to a rotary gland 13 which is positioned in such a way that its axis of rotation extends thwartships in horizontal direction, forming the hinged coupling between the first suction pipe section and a second suction pipe section 14.

The second suction pipe section 14 is connected to the rotary gland 13 with a 90° bend 15 (see FIG. 2). To said bend 15 there is rigidly attached a journal 16 having an axis that coincides with that of the rotary gland 13, and rotatably mounted in the support portion 11. The second suction pipe section comprises a further pivot 17 whose pivot pin is situated in the plane of drawing (FIG. 1) and perpendicular to the axis of the second suction pipe section 14. The latter section is controllable by a hoisting device 18 which is positioned on the end of the ladder 3 adjacent the rotary flange 6 and adapted for coaction with a hoist 20 via rope 19. The second suction pipe section 14 is furthermore coupled to a third suction pipe section 22 via a hinge coupling 21, the axis of which is perpendicular to the plane of drawing (FIG. 1).

The third suction pipe section 22 terminates in a suction nozzle 23 and is controllable by a hoisting device 24 which is adapted for coaction with a hoist 26 via a rope 25.

The suction dredger installation may furthermore be provided with a plurality of conventional facilities, such as one or more rotary glands in the suction pipe sections themselves, e.g. at 29 or a jet-water supply adjacent the suction nozzle. Such and other facilities however are of less relevance to the present invention subject and consequently are left out of consideration.

By means of a thus designed suction dredger installation it is possible to displace the suction nozzle 23 over a large distance, moving substantially vertically. In illustration thereof, reference is made to FIG. 1, wherein a deep suction position is shown by drawn lines and a high suction position by a dashed line 27, said suction nozzle being displaced only in vertical direction relative to that in the deep suction position. By a suitable control of the suction pipe, the suction nozzle can be brought in any position on the connection line between both positions represented.

This may also be effected in case of a substantially constant angle enclosing the third suction pipe section 22 with the bottom, which is in particular of importance for sand-pump dredgers with drag nozzles, since otherwise the cutting effect cannot be optimal or even the contact with the bottom can be broken, so that not only the efficiency is adversely affected, but also the required suction pattern or the bottom profile to be obtained is abandoned.

The control and determination of the position of the first suction pipe section (or the ladder 3) relative to the second suction pipe section 14 is possible simply but efficiently and accurately by the advantageous positioning of the hoisting device 18 on the end of of the ladder 3. As a result the ladder 3, the second suction pipe section 14 and the rope 19 constitute a triangle, the length of two sides of which, viz. that of the ladder 3 and that of the second suction pipe section 14, are fixed, while the length of the third side, the rope 19, as well as the angle that the ladder 3 encloses with the vessel 1, can be determined simply and accurately.

Besides the suction pipe has a particularly advantageous storing position, which is indicated in FIG. 1 by a dotted line 28. In said storing position the second suction pipe section 14 is in a collapsed position underneath the ladder 3. This is enabled by the hinging property to 0° of the coupling between the first and the second suction pipe section, which in the construction shown in FIG. 1 is made possible in particular by the support portion 11 and the rotary gland 13. The connection tube 12 thereby has such a shape that the width of the suction pipe remains minimal, which inter alia favours the play of forces on the ladder 3. By the collapsed condition of the first and the second suction pipe section in the stored position, the suction pipe according to the invention occupies considerably less length than with the prior art suction pipes, the respective connections of which in the stored position are coextensive in linked position.

Furthermore facilities may be present for bringing the suction pipe in the position 28 entirely aboard through a thwartships displacement, so that all sections are optimally accessible.

It stands to reason that many other variants and modifications are possible within the scope of the invention. For instance the rotary gland coupling 13 may be replaced by a different hinged connection adapted to perform the required pivoting movment, e.g. by means of bends and flexible pipe sections. Also the connection tube 12 may have a double and/or mirror-symmetrical design.

I claim:

1. In a dredger installation carried by a floating vessel, a suction pipe comprising first, second and third pipe sections, the first pipe section being supported by and movable with a ladder pivoted at its upper end to the vessel for swinging movement about a horizontal axis which is transverse to the vessel, a pivotal coupling between the first and second pipe sections permitting these sections to enclose a mutual angle between 0° and 180° in lazy tong relationship, means for controlling the position of the second pipe section relative to the first pipe section, said means including a lifting device carried on the ladder adjacent said horizontal axis and an elongated flexible line connected between the lifting device and the second pipe section, and a pivotal connection between the second pipe section and the third pipe section.

2. A dredger installation as in claim 1 including a pump carried by the ladder near the lower end thereof adjacent the pivotal coupling between the first and second pipe sections, the pump having an outlet connected to the first pipe section and having an inlet, the pivotal coupling between the first and second pipe sections including a rotary gland arranged with its axis horizontal and transverse to the vessel, a first connection tube extending between one end of the rotary gland and the inlet of the pump and a second connection tube between the opposite end of the rotary gland and the second pipe section, said first connection tube forming a generally Z-shaped bend, said bend having end legs which substantially lie in mutually parallel planes and which are perpendicular to each other.

3. A dredger installation as in claim 2 wherein said gland has a horizontal axis of rotation, said Z-shaped bend being arranged such that it has a lower end leg coaxial with said gland axis, and said opposite end of said connection tube including a 90° bend.

* * * * *